US008408652B1

(12) United States Patent
Mobley, Sr.

(10) Patent No.: US 8,408,652 B1
(45) Date of Patent: Apr. 2, 2013

(54) ADJUSTABLE FOOT REST

(76) Inventor: Frank L. Mobley, Sr., Ashford, AL (US)

( * ) Notice: Subject to any disclaimer, the term of this patent is extended or adjusted under 35 U.S.C. 154(b) by 76 days.

(21) Appl. No.: 12/974,835

(22) Filed: Dec. 21, 2010

(51) Int. Cl.
*A47C 16/00* (2006.01)

(52) U.S. Cl. ..... 297/423.44; 297/423.1; 297/423.17; 297/423.39; 297/423.41; 297/423.45

(58) Field of Classification Search ..... 297/423.1, 297/423.17, 423.39, 423.41, 423.44, 423.45
See application file for complete search history.

(56) References Cited

U.S. PATENT DOCUMENTS

| | | | | | |
|---|---|---|---|---|---|
| 621,098 | A | * | 3/1899 | Kelly | 248/371 |
| 787,674 | A | * | 4/1905 | Kelly | 297/423.25 |
| 998,996 | A | | 7/1911 | Swenson et al. | |
| 1,399,837 | A | * | 12/1921 | Wood | 5/651 |
| D92,703 | S | * | 7/1934 | Crego | D6/335 |
| 2,375,225 | A | * | 5/1945 | Herbert | 5/651 |
| 2,384,234 | A | * | 9/1945 | Breese | 297/2 |
| 2,473,947 | A | * | 6/1949 | Hamstrom | 297/423.45 |
| 2,576,883 | A | | 11/1951 | Koski | |
| 2,960,151 | A | | 11/1960 | Fairgrieve | |
| 3,104,446 | A | * | 9/1963 | Throop, Jr. | 27/21.1 |
| 3,264,033 | A | * | 8/1966 | Hansburg | 297/423.39 |
| 3,696,826 | A | * | 10/1972 | Gruzalski | 135/65 |
| 3,981,030 | A | * | 9/1976 | Turner | 5/656 |
| 4,118,812 | A | * | 10/1978 | Pangburn | 5/657 |
| 4,432,108 | A | * | 2/1984 | Chapman | 5/648 |
| 4,536,032 | A | * | 8/1985 | Highberger | 297/423.41 |
| 4,549,767 | A | | 10/1985 | Hampshire et al. | |
| 4,550,901 | A | * | 11/1985 | Muchisky et al. | 5/630 |
| 4,692,954 | A | | 9/1987 | Scott, Sr. | |
| 4,826,151 | A | * | 5/1989 | Nuredin | 482/68 |
| 5,101,526 | A | | 4/1992 | Smith | |
| 5,201,568 | A | | 4/1993 | Christensen, Jr. | |
| 5,603,336 | A | | 2/1997 | Shepich | |
| 6,438,777 | B1 | * | 8/2002 | Bender | 5/630 |
| 6,695,754 | B1 | * | 2/2004 | Gazzolo | 482/141 |
| 6,921,135 | B2 | * | 7/2005 | Ellis et al. | 297/344.18 |
| 6,935,697 | B2 | * | 8/2005 | Conlon et al. | 297/423.41 |
| 6,935,992 | B2 | * | 8/2005 | Gehrke | 482/146 |
| 7,669,934 | B1 | * | 3/2010 | Cline | 297/423.45 |

* cited by examiner

*Primary Examiner* — Laurie Cranmer
(74) *Attorney, Agent, or Firm* — Montgomery Patent & Design LLC; Robert C. Montgomery

(57) ABSTRACT

An adjustable footrest includes a pair of side members connected edge to edge by a plurality of hinges. A plurality of padded semi-circular apertures, located along the connected edges between the hinges, allows a user to rest his feet and legs in an elevated position, as required by certain medical conditions. The level of elevation is incrementally adjusted by widening or narrowing and subsequently locking the apex angle. An additional means of incremental elevation adjustment includes a plurality of telescoping legs and floor pads.

14 Claims, 4 Drawing Sheets

ADJUSTABLE FOOT REST

RELATED APPLICATIONS

The present invention was first described in a notarized Official Record of Invention on Mar. 22, 2010, that is on file at the offices of Montgomery Patent and Design, LLC, the entire disclosures of which are incorporated herein by reference.

FIELD OF THE INVENTION

The present invention relates generally to footrests, and in particular, to a footrest with an elevation adjustment capable of supporting the feet of a user having a plurality of semicircular recesses for comfortably supporting the ankles of the user at different positions.

BACKGROUND OF THE INVENTION

Patients are often asked to keep their legs in an elevated position. The reasons for such a request include recovery after leg or foot surgery, to combat leg swelling and water retention, and to even help with congestive heart failure. Most people utilize a chair, a footstool, or other footrest to meet such requests, but such devices never seem to be comfortable or support the legs at the right height. Even if the user finds a comfortable position or elevation, after a short time the position must be adjusted. Additionally, the user may want or need to keep the feet separated or may want one leg elevated and one leg lowered at any given time. Many people even resort to the use of pillows while lying down, but pillows collapse over time and move about. Additionally, neither of these solutions allows for ready and simple height adjustment during use to facilitate comfort and neither aids in keeping the legs apart to help in healing.

While various available fixed and adjustable footrests may offer a benefit to a user, each suffers from at least one (1) deficiency or disadvantage in design or utilization. Fixed footrests are limiting in position, elevation, and comfort. Different adjustable footrests are complex, heavy, and difficult to manufacture and use.

SUMMARY OF THE INVENTION

The inventor recognized the aforementioned inherent problems and lack in the art and observed that there is a need for a device and method of use by which legs and feet can be kept in an elevated and comfortably spaced position which addresses the deficiencies of current methodology as described. It is an object of the present disclosure to solve these problems.

The inventor recognized these problems and has addressed this need by developing an adjustable footrest which allows those recovering from foot surgery or suffering from debilitative diseases the ability to keep their feet and legs elevated or separated in a manner which is quick, easy, and effective. The inventor has thus realized the advantages and benefits of providing a generally upstanding first side member having a first upper edge, a first lower edge, and opposing first side edges and an opposing generally upstanding second side member having a second upper edge, a second lower edge, and opposing second side edges. A plurality of hinges are provided to pivotably couple the first side member to the second side member along the first upper edge and the second upper edge to allow for the opening and closing movement of the first lower edge and the second lower edge relative to each other. This movement provides for a simple and effective method of adjusting the elevation of the footrest and foot supporting surfaces. A pair of adjusting straps is coupled between and extends transversely to the lower edges for securing the position of the first lower edge relative to the second lower edge. The first side member and the second side member each include a plurality of semicircular upper recesses disposed along coincident upper edges for supporting the ankles of the user. Additionally, the semicircular upper recesses each have a cushioned material affixed to an inner periphery to provide a more comfortable support surface.

The inventor also recognized the benefits of providing a pair of telescoping legs attached to each side member and extending past the lower edges for contacting the floor surface. The opposing vertical side edges of each of the side members also include a pair of additional semicircular recesses for supporting the ankle of the user at a different elevation and tilt angle. These semicircular recesses also include a cushioned material affixed to an inner periphery to provide a more comfortable support surface.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
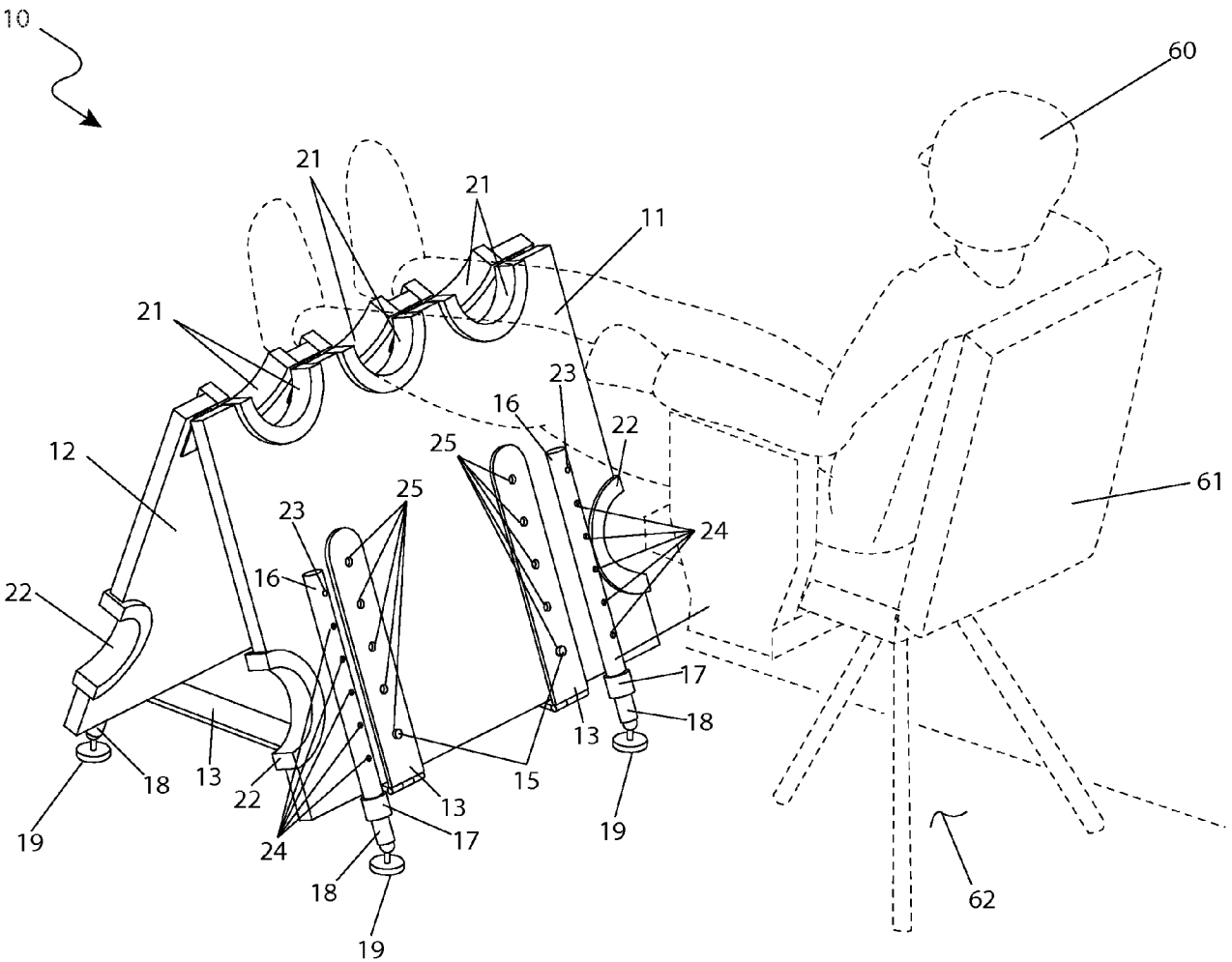
FIG. 1 is an environmental perspective view of an adjustable footrest 10, according to a preferred embodiment.

10 adjustable footrest
11 first side member
12 second side member
13 adjusting strap
14 hinge
15 pin
16 first telescoping member
17 locking collar
18 second telescoping member
19 floor pad
21 first padding
22 second padding
23 detent ball
24 detent aperture
25 adjusting aperture
60 user
61 chair
62 floor

DETAILED DESCRIPTION OF THE PREFERRED EMBODIMENT

The best mode for carrying out the disclosure is presented in terms of a preferred embodiment, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present disclosure describes an adjustable footrest (herein described as a "device") 10, which provides for the resting of legs and feet of a user 60 in a comfortable elevated and spaced position.

Referring now to FIG. 1, an environmental perspective view of the device 10 is disclosed. The device 10 is depicted keeping the legs and feet of the user 60 in an elevated position while seated in a chair 61. The device 10 includes a first side member 11 and a similar second side 12 member, each further including a plurality of similar semi-circular recesses cut along an upper edge portion and covered by a first padding 21. The first side member 11 and the second side member 12 are pivotably joined along coincidental longitudinal upper edges by at least one hinge 14, thereby forming a configuration similar to an "A" shape when in use. An elevation adjustment of the device 10 is achieved by widening or narrowing the distance between opposing lower longitudinal edges of the side members 11, 12 and thus an apex angle of the "A" configuration. The device 10 also includes a pair of adjusting straps 13 removably attached between exterior surfaces of the first side member 11 and the second side member 12. The adjustable elevation is secured by inserting one of a plurality of adjusting apertures 25 longitudinally disposed through the adjusting straps 13 onto a pin 15 protruding from the exterior surface of the side members 11, 12. The device 10 also includes a pair of telescoping legs mounted to each side member 11, 12. The legs include an outer first telescoping member 16 and an inner second telescoping member 18 insertingly attached therewithin. A secondary elevating adjustment is achieved by uniformly extending each second telescoping member 18 outwardly from the corresponding first telescoping member 16 until a desired extended length is achieved. The second telescoping member 18 is secured within the first telescoping member by a spring loaded detent ball 23 which snaps into a corresponding one (1) of a plurality of detent aperture 24 disposed within each first telescoping member 16. Each first telescoping member 16 also includes a locking collar 17 connected to a lower end portion. The locking collar 17 includes an inner collet which tightens around the second telescoping member 18 and restricts axial movement of the second telescoping member 18 relative to the first telescoping member 16. A clockwise rotation of locking collar 17 firmly secures this position.

Figure 2:
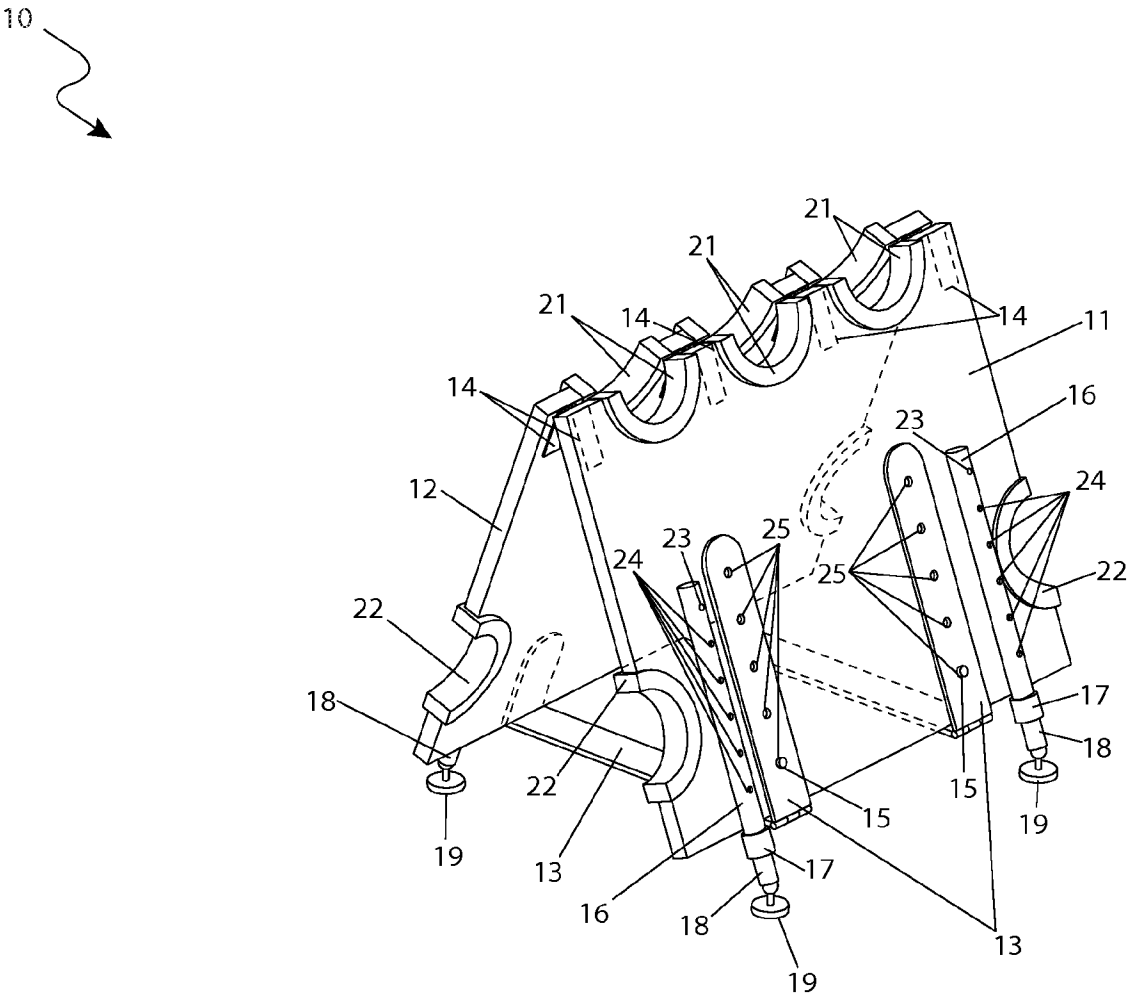
FIG. 2 is a perspective view of the adjustable footrest 10 in an elevated state, according to the preferred embodiment.

Referring now to FIG. 2, a perspective view of the device 10 in the elevated state is disclosed. The hinge 14 includes a first half which is fastened onto an upper inner edge portion of the first side member 11 between each first padding 21. A second half of each hinge is fastened onto an opposing upper inner edge portion of the second side member 12 between each first padding 21. Each side member 11, 12 includes the pair of fastened first telescoping members 16 having a plurality of detent apertures 24 and the locking collar 17. Each second telescoping member 18 is slidingly installed within each first telescoping member 16 and includes the spring loaded detent ball 23 and a swiveling floor pad 19. A first end of each adjusting strap 13 is permanently fastened onto a lower exterior surface of the second side member 12. An opposing second end of each adjusting strap 13 includes the plurality of adjusting apertures 25 which maintain the desired elevation adjustment by fitting a selected adjusting aperture 25 onto the pin 15. The assembly of each first telescoping member 16 and second telescoping member 18 provide for incrementally increasing the elevation of the device 10 to an additional level beyond the range of the first adjustment. The floor pad 19 is connected to a lower end portion of each second telescoping member 18 and maintains the device 10 in a stable position upon a floor surface 62. This additional elevation is useful in cases where the ankles of the seated user 60 must be elevated to a level corresponding to a location of his heart. Furthermore, each lower side edge portion of the first side member 11 and the second side member 12 includes an additional lateral semi-circular aperture cushioned by a second padding 22, intended for cases where the legs of the user 60 are to be kept apart at a lower elevation.

Figure 3:
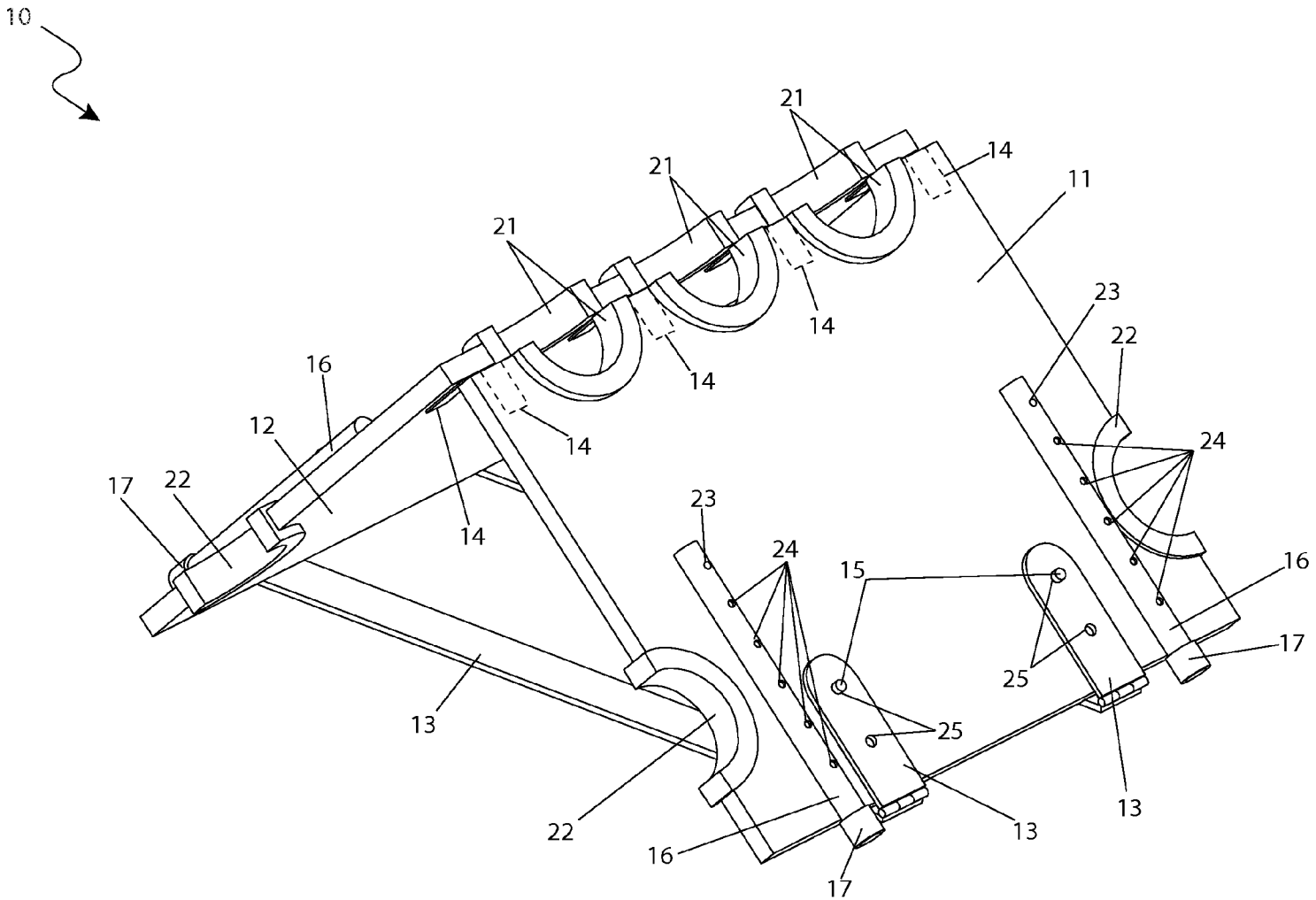
FIG. 3 is a perspective of the adjustable footrest 10 in a lowered state, according to the preferred embodiment; and, FIG. 4 is a perspective view of a second telescoping member 18 of the adjustable footrest 10, according to the preferred embodiment.

Referring now to FIG. 3, a perspective view of the device 10 in the lowered state is disclosed. The device 10 is depicted with the pair of adjusting straps 13 extended into a far limit wherein the last adjusting aperture 25 of each adjusting strap 13 is secured onto the corresponding pin 15. The second telescoping members 18 are depicted removed from the first telescoping members 16 due to the wide apex angle being beyond the capability of the floor pads 19 to effectively contact the floor 62.

It is envisioned that the first side member 11 and the second side member 12 are made of wood, composite laminate, fiberglass, carbon fiber, polymeric or acrylic plastic materials. The hinges 14 can be made of plastic, brass, aluminum, or stainless steel. The first telescoping members 16 and the second telescoping members 18 are envisioned to be made of commercially available plastic, fiberglass or steel tubing material. The first padding 21 and the second padding 22 include a foam interior and a covering made of materials such as: vinyl, canvass, leather, imitation leather, or NYLON®. The pair adjusting straps 13 is envisioned to be made of a canvass or NYLON® webbing material.

Figure 4:
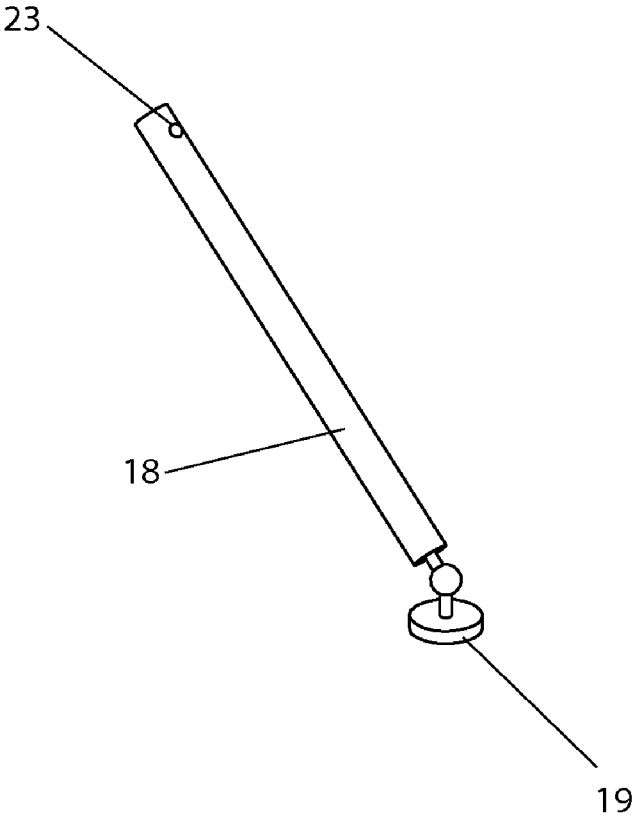

Referring now to FIG. 4, a perspective view of the second telescoping member 18 is disclosed. The second telescoping member 18 includes the swiveling floor pad 19 and the detent ball 23. When slidingly assembled within each first telescoping member 16, the second telescoping members 18 provide for incrementally raising the elevation of the device 10 to a higher elevation than achievable by adjusting the apex angle of the "A" configuration. The floor pads, made of a no-slip and non-marring material, are intended to provide the elevated device 10 with a stable and safe footing.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: unpacking the assembled device 10; moving the device 10 to the location of the user 60; determining a desired elevation of the user's feet; setting the elevation to the determined level by adjusting the apex angle between the first side member 11 and the second side member 12; using each adjusting strap 13 to secure the elevation adjustment by placing a corresponding adjusting aperture 25 onto each pin 15; raising and placing each leg of the user 60 into the selected first padding 21; readjusting the elevation to an optimum level of user 60 comfort by moving the adjusting strap 13 to an alternate adjusting aperture 25; or, raising a first end of the device 10 with a first hand; using a second hand to rotate each of the pair of nearby locking collars 17 counterclockwise to free the motion of the second telescoping member 18; extending each of the pair of nearby second telescoping members 18 to a desired length; allowing each detent balls 23 to snap into the corresponding aperture 24; performing similar steps at a second end of the device 10; locking the elevation by rotating each locking collar 17 clockwise; readjusting the posture of the user 60 as needed; uninstalling the device 10 after usage by following the above steps in a reverse order; and, cleaning, folding and storing the device 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An adjustable footrest comprising:

a support member having a generally upstanding first side member and an opposing generally upstanding second side member;

at least one hinge for pivotably coupling said side members together along coincident upper edges for allowing opening and closing movement relative to each other; and, at least one adjusting strap coupled between and extending transversely to said side members for securing a position of said side members relative to each other;

wherein said coincident upper edges of said side members further comprise a plurality of semicircular recesses for supporting an ankle of a user; and, wherein opposing vertical side edges of each of said side members further comprise a semicircular recess for supporting said ankle of said user.

2. The footrest of claim 1, wherein said at least one adjusting strap further comprises an end affixed to said second side member and an opposing end removably coupled to said first side member.

3. The footrest of claim 2, wherein said first side member further comprises at least one pin protruding outwardly from an exterior surface for insertingly engaging one of a plurality of adjusting strap apertures disposed longitudinally through said at least one adjusting strap.

4. The footrest of claim 1, wherein said semicircular recesses each further comprises a cushioned material affixed to a periphery.

5. The footrest of claim 1, further comprising a pair of telescoping legs attached to each side member and extending past a lower edge portion for contacting a floor surface.

6. The footrest of claim 5, wherein each of said telescoping legs further comprises:

an outer telescoping member mounted to an exterior surface of said side member;

an inner telescoping member adjustably coupled within said outer telescoping member; and, a locking mechanism for fixing a position of said inner telescoping member relative to said outer telescoping member.

7. The footrest of claim 6, wherein said locking mechanism further comprises:

a spring actuated detent ball disposed on an upper end of said inner telescoping member; and, a plurality of detent apertures disposed longitudinally through a front surface of said outer telescoping member;

wherein said detent ball partially extends into one of said plurality of detent apertures when said inner telescoping member is inserted within said outer telescoping member forming a mechanical interlock.

8. The footrest of claim 7, wherein said locking mechanism further comprises a locking collar disposed at a lower end of said outer telescoping member, said locking collar having a collet for clamping around said inner telescoping member when said locking collar is rotated about said outer telescoping member.

9. The footrest of claim 7, wherein each of said inner telescoping members further comprises a floor pad rotatably coupled to a lower end for maintaining planar contact with said floor surface.

10. The footrest of claim 1, wherein said semicircular recesses each further comprises a cushioned material affixed to a periphery.

11. An adjustable footrest comprising:

a generally upstanding first side member having a first upper edge, a first lower edge, and opposing first side edges;

an opposing generally upstanding second side member having a second upper edge, a second lower edge, and opposing second side edges;

a plurality of hinges for pivotably coupling said first side member to said second side member along said first upper edge and said second upper edge for allowing opening and closing movement of said first lower edge and said second lower edge relative to each other;

a pair of telescoping legs, each attached to each side member, each telescoping leg further comprising:

an outer telescoping member mounted to an exterior surface of said side member;

an inner telescoping member adjustably coupled within said outer telescoping member extending past said lower edge;

a locking mechanism for fixing a position of said inner telescoping member relative to said outer telescoping member; and, a floor pad rotatably coupled to a lower end of said inner telescoping member for maintaining planar contact with said floor surface; and, a pair of adjusting straps coupled between and extending transversely to said lower edges for securing a position of said first lower edge relative to said second lower edge, each further comprising an end affixed to said second side member and an opposing end removably coupled to said first side member;

wherein said first side member and said second side member each further comprise a plurality of semicircular upper recesses disposed along coincident upper edges for supporting an ankle of a user;

wherein said upper recesses each further comprises a cushioned material affixed to a periphery thereof;

wherein said first side edges and said second side edges each further comprise opposing semicircular side recesses for supporting said ankle of said user;

wherein said side recesses each further comprises a cushioned material affixed to a periphery thereof; and, wherein said first side member further comprises a pair of pins protruding outwardly from an exterior surface for insertingly engaging one of a plurality of adjusting strap apertures disposed longitudinally through each of said pair of adjusting straps.

12. The footrest of claim 11, wherein said locking mechanism further comprises:

a spring actuated detent ball disposed on an upper end of said inner telescoping member; and, a plurality of detent apertures disposed longitudinally through a front surface of said outer telescoping member;

wherein said detent ball partially extends into one of said plurality of detent apertures when said inner telescoping member is inserted within said outer telescoping member forming a mechanical interlock.

13. The footrest of claim 12, wherein said locking mechanism further comprises a locking collar disposed at a lower end of said outer telescoping member, said locking collar having a collet for clamping around said inner telescoping member when said locking collar is rotated about said outer telescoping member.

14. A method of supporting at least one foot of a user at an adjustable elevation, said method comprising the steps of:

providing an adjustable footrest comprising a generally upstanding first side member having a first upper edge, a first lower edge, and opposing first side edges; an opposing generally upstanding second side member having a second upper edge, a second lower edge, and opposing second side edges; a plurality of hinges for pivotably coupling said first side member to said second side member along said first upper edge and said second upper edge; a pair of adjusting straps coupled between and extending transversely to said lower edges for securing a position of said first lower edge relative to said second lower edge; and, a pair of pins protruding outwardly from an exterior surface of said first side member for insertingly engaging one of a plurality of adjusting strap apertures disposed longitudinally through each of said pair of adjusting straps;

wherein opposing vertical side edges of each of said side members further comprise a semicircular recess for supporting said ankle of said user determining a desired elevation of said at least one foot of said user;

securing said elevation by opening and closing movement of said first lower edge and said second lower edge relative to each other;

removably coupling said adjusting strap to said side members to secure said elevation by placing a corresponding adjusting strap aperture onto said pins; and, raising and placing a leg of said user into one of said plurality of recesses.

* * * * *